United States Patent [19]

Durham

[11] Patent Number: 4,553,612

[45] Date of Patent: Nov. 19, 1985

[54] EARTH BORING MACHINE

[76] Inventor: Marion E. Durham, 10 Curtis Rd., Greenville, S.C. 29611

[21] Appl. No.: 549,876

[22] Filed: Nov. 9, 1983

[51] Int. Cl.[4] ..... E21B 7/20

[52] U.S. Cl. ..... 175/122; 175/171; 175/202; 175/203; 175/220; 173/152

[58] Field of Search ..... 175/122, 162, 171, 173, 175/220, 202, 203; 173/42, 43, 39, 44, 152, 148

[56] References Cited

U.S. PATENT DOCUMENTS

| | | | |
|---|---|---|---|
| 3,028,922 | 4/1962 | Hudnall, Jr. | 173/43 |
| 3,107,741 | 10/1963 | Adams et al. | 175/122 |
| 3,174,562 | 3/1965 | Stow | 175/122 |
| 3,390,730 | 7/1968 | Techy et al. | 175/171 |
| 3,682,261 | 8/1972 | Bird | 175/122 |
| 3,730,285 | 5/1973 | Anderson et al. | 175/220 |
| 4,105,081 | 8/1978 | Perrand | 175/122 |
| 4,158,520 | 6/1979 | Prebensen | 173/43 |
| 4,251,046 | 2/1981 | Walmsley et al. | 173/43 |

FOREIGN PATENT DOCUMENTS

| | | | |
|---|---|---|---|
| 275884 | 6/1914 | Fed. Rep. of Germany | 175/122 |

*Primary Examiner*—James A. Leppink
*Assistant Examiner*—Hoang C. Dang
*Attorney, Agent, or Firm*—Julian W. Dority

[57] ABSTRACT

An earth boring machine for boring straight and level elongated holes through rock-laden earth. The machine includes a stationary elongated frame upon which a first slide is carried. A second slide is carried on the first slide. An elongated auger guiding sleeve is carried adjacent one end of the first slide and has a cutting edge on a remote end thereof. A power-driven auger assembly is carried on the second slide and includes an auger which extends within the guiding sleeve. A cutting tool is carried on the end of the auger adjacent a remote end of the guiding sleeve. An hydraulic cylinder is provided for advancing the first sleeve for driving the cutting edge of the guiding sleeve into the earth while the power driven auger removes the earth as the guiding sleeve is advanced. Another set of hydraulic cylinders are provided for advancing the second slide on the first slide causing the cutting tool to extend out beyond the remote end of the guiding sleeve for cutting through obstructions in the earth when the cutting edge of the guiding sleeve is prevented from moving forward.

5 Claims, 7 Drawing Figures

30
32
34
36
28
18
20
22
66
62
56
58
14
10
84
100
46

Fig. 6.
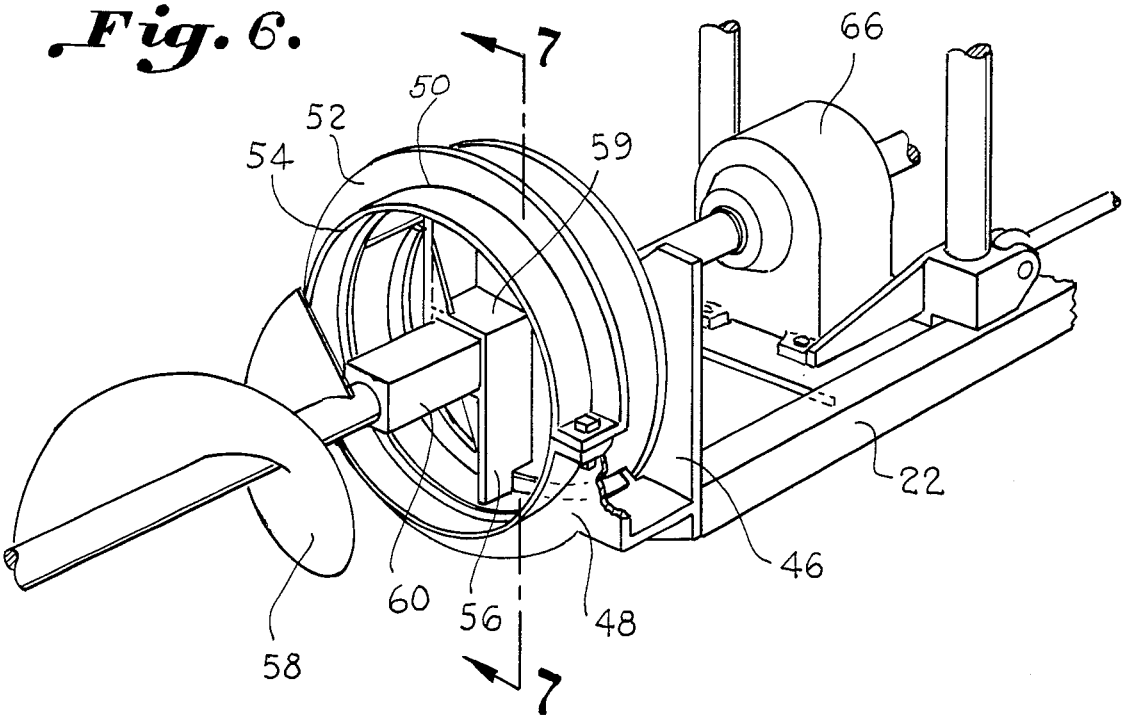
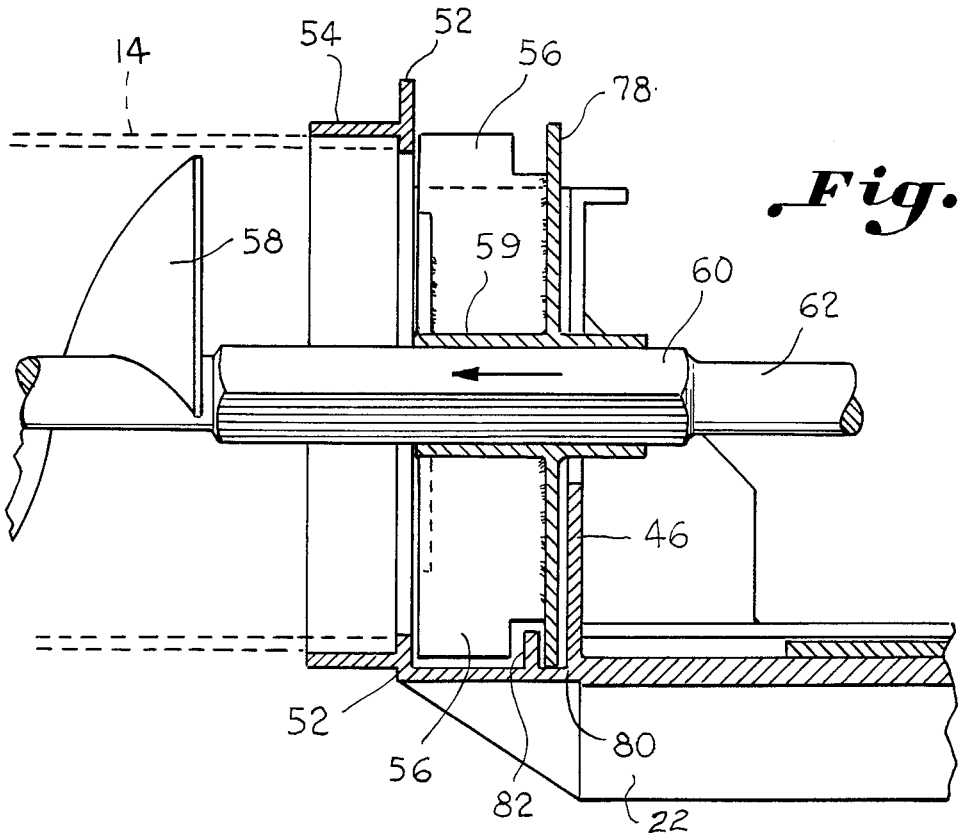
Fig. 7.

EARTH BORING MACHINE

BACKGROUND OF THE INVENTION

Heretofore, when boring tunnels through earth such as for accommodating pipes and the like which extend under roads, such as normally done by an earth boring machine. These machines would be mounted on rails so that the auger associated with the boring machine drilled a hole into the earth, the machine could be shifted forward on the rails. The auger would rotate within an elongated sleeve and normally a hydraulically operated cylinder would force the sleeve into the embankment and the auger sould remove the dirt as such was forced forward. One problem with such devices is that when the sleeve would strike a rock formation, it was necessary to remove the sleeve from the hole being bored and the auger inserted back in with a cutting head for cutting through the rock formation. Such a method was time-consuming.

The reason it is necessary to rotatably mount the auger within the elongated sleeve is to ensure a true and level hole is bored through the embankment. If the sleeve were not present, the rotational force of the auger would tend to cause the auger to follow a direction which would be downwardly and to the right of the desired central axis of the hole or tunnel being bored.

Whn it is necessary to remove the sleeve in which the auger is rotating during the boring operation as a result of striking rocks and the like, it is difficult to reinsert the sleeve back in the identical hole. Furthermore, such is a time-consuming operation.

SUMMARY OF THE INVENTION

Accordingly, it is an important object of the present invention to provide an earth boring machine for boring straight and level elongated holes through rock laden earth.

Another important object of the present invention is to provide an earth boring machine wherein a cutting tool can be placed on the end of a conventional auger for cutting into rock out beyond the end of a guide tube associated with an earth boring machine.

The earth boring machine constructed in accordance with the present invention includes a stationary elongated frame having a first slide carried thereon. A second slide is carried on the first slide and an elongated auger guiding sleeve is carried adjacent one end of the first slide. The guiding sleeve has a cutting edge on the remote end thereof. A power-driven auger assembly is carried on the second slide. The power-driven auger includes an elongated auger carried within the guiding sleeve with a cutting tool being carried on the end thereof. Pneumatically-operated cylinders are provided for advancing the first slide on the frame for driving the cutting edge of the guiding sleeve into the earth while the power driven auger removes the earth from the sleeve as the sleeve is advanced into the earth.

Another power-operated cylinder is provided for advancing the second slide on the first slide for causing the cutting tool carried on the end of the auger to extend out beyond the remote end of the guiding sleeve for cutting through obstructions such as rock beds in the earth.

The construction designed to carry out the invention will be hereinafter described, together with other features thereof.

The invention will be more readily understood from a reading of the following specification and by reference to the accompanying drawings forming a part thereof, wherein an example of the invention is shown and wherein:

BRIEF DESCRIPTION OF THE DRAWING

FIG. 6 is an enlarged perspective view illustrating an auger portion of the earth boring machine, and FIG. 7 is a sectional view taken along line 7—7 of FIG. 6.

DESCRIPTION OF A PREFERRED EMBODIMENT

Figure 2:
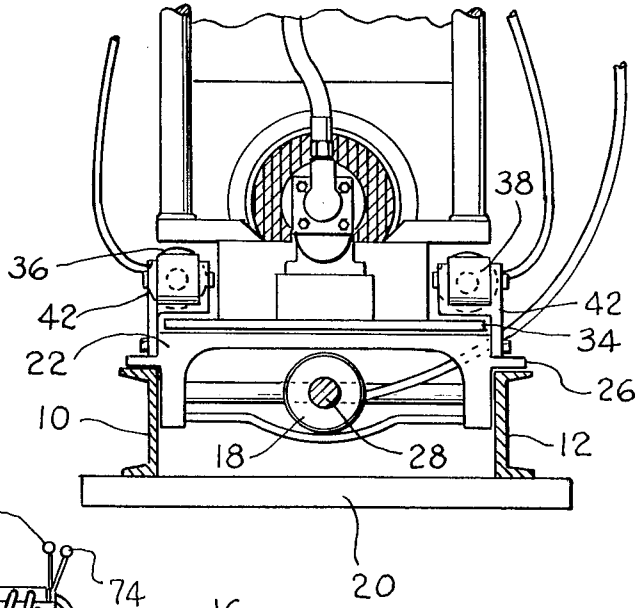
FIG. 2 is an end view taken along line 2—2 of FIG. 1.
Figure 1:
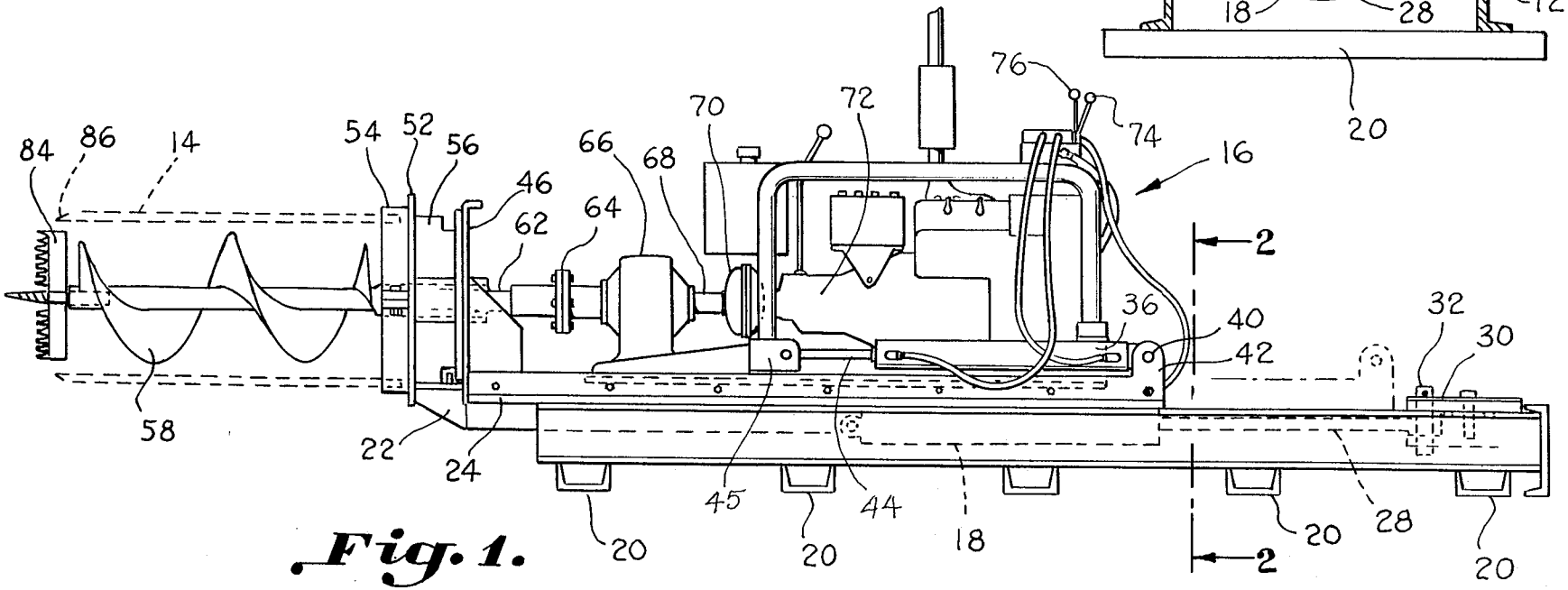
FIG. 1 is a side elevational view illustrating an earth boring machine constructed in accordance with the present invention.

Referring in more detail to FIGS. 1 and 2 of the drawing, there is illustrated a pair of channel members 10 and 12 which define rails upon which the earth boring machine rests during the boring operation. These rails can be of any suitable length, but normally must be longer than the length of one section of a guiding tube 14 carried on the end of the earth boring machine. During the boring or tunneling operation, the entire machine shown by the reference character 16 is first shifted to the left by means of a hydraulically driven cylinder 18 and then shifted back to the right on the rails 10 and 12 so that another section of guiding tube 14 can be added to the tube previously inserted in the hole being dug through the embankment. The ends of the adjoining tubes are welded together.

The rails 10 and 12 are carried on any suitable cross ties 20. Positioned on top of the channel-shaped rails 10 and 12 is a first slide 22 which has outwardly extending flanges 24 and 26 provided thereon which rests on top of the rails 10 and 12. The first slide moves relative to the rails 10 and 12 responsive to the main hydraulic cylinder 18 extending its piston 28. The outer end of the piston 28 is anchored to a plate 30 extending between the rails 10 and 12 by means of a pin 32. Thus, when the piston 28 is extended out of the cylinder 18, the entire earth boring machine which rests on top of the first slide 22 slides along the rails 10 and 12.

A second slide 34 rests on top of the upper horizontal surface of the first slide plate 22. A pair of hydraulically-operated 36 and 38 are provided for moving the second slide plate relative to the first slide plate. One end of the cylinders 36 and 38 is connected to a pin 40 which extends between a pair of spaced flanges 42 extending upwardly from and fixed to the lower first side plate. A piston 44 extends out the end of the cylinders 36 and 38 and has its outer end attached to a bracket 45 which, in turn, is fixed to the upper second slide plate 34. As a result of manipulating the piston rod 44 associated with the double acting hydraulic cylinders 36 and 38, the second slide plate 34 can be moved relative to the first slide plate 22.

First, the structure that is carried and fixed to the first lower slide plate 22 will be described. Shown on the left end of the lower slide plate 22 is a vertically extending plate 46 that has attached thereto a semi-circular clamping member 48. Positioned above the clamping member 48 is a complimentary shaped semi-circular clamping member 50. The clamping members 48 and 50 have a radially extending flange 52 that is joined by a horizontally extending flange 54. As can be seen in FIGS. 1, 6 and 7, the lower portion 52 of the radially extending flange 52 is fixed to the end of the sled 22 and is spaced from the fixed plate 46. Interposed between the fixed, vertically extending back plate 46 and the flanges 52 are steel paddle wheels 56 that engage the dirt being fed through the tubular guide sleeve 14 by an auger 58. As the earth or dirt engages the rotating paddle wheels 56, it is thrown to the side of the machine. It is noted that the sides between the flanges 52 and 46 are open. The paddle wheels 56, in turn, are welded to a substantially square housing 59 through which a correspondingly-shaped square post 60 extends. The post 60 is not fixed to the inner walls of the square housing 59 and is allowed to move back and forth throughout responsive to movement of the auger 58. The outer end of the horizontally extending square post 60 is fixed to the inner end of the shaft of the auger 58. The other side of the square post 60 is integral with an elongated shaft 62 that is, in turn, connected through a coupling 64 to the output of a gear reducer 66. The other side of the gear reducer 66 is connected by means of a shaft 68 to a flexible coupling 70. The flexible coupling 70 is, in turn, connected to an output shaft of a gasoline engine 72 which causes the entire auger to be rotated when energized.

Positioned on top of the engine 72 are levers 74 and 76 which are used for operating the main cylinder 18 for shifting the entire boring machine and for operating the two cylinders 36 and 38 which are used for shifting the second slide 34 on the first slide 22.

The engine 72 and gear reducer 64 are supported on the upper second slide while the clamp 48 which supports the guiding sleeve 14 is supported on the lower first side. As a result, when the hydraulic cylinders 36 and 38 are activated, the auger can be moved relative to the sleeve 14 as shown in FIG. 1. Extending radially outwardly from the square-shaped bracket 59 upon which the paddle wheels are attached is a disk 78 which rides on surface 80 as the auger is rotated for aiding in stabilizing and supporting the auger 58. The disk 78 is positioned between the backplate 46 and a raised flange 82 as shown in FIG. 7 and acts as a bearing means for said auger.

Positioned on the outer end of the auger 58 and connected thereto by any suitable means in a rock cuttinb bit 84. This bit can be of any suitable construction, and when it is desired to cut through rock-laden earth, it is necessary that the bit extend longitudinally out beyond the end of the guiding sleeve 14. However, during normal boring operation, it is preferred that the bit 84 be retracted back within the end of the guiding sleeve 14 and the cutting operation would take place by the sharpened edge 86 carried on the sleeve 14 as it is pushed by the hydraulic power source into the earth.

Figures 3, 4, 5:
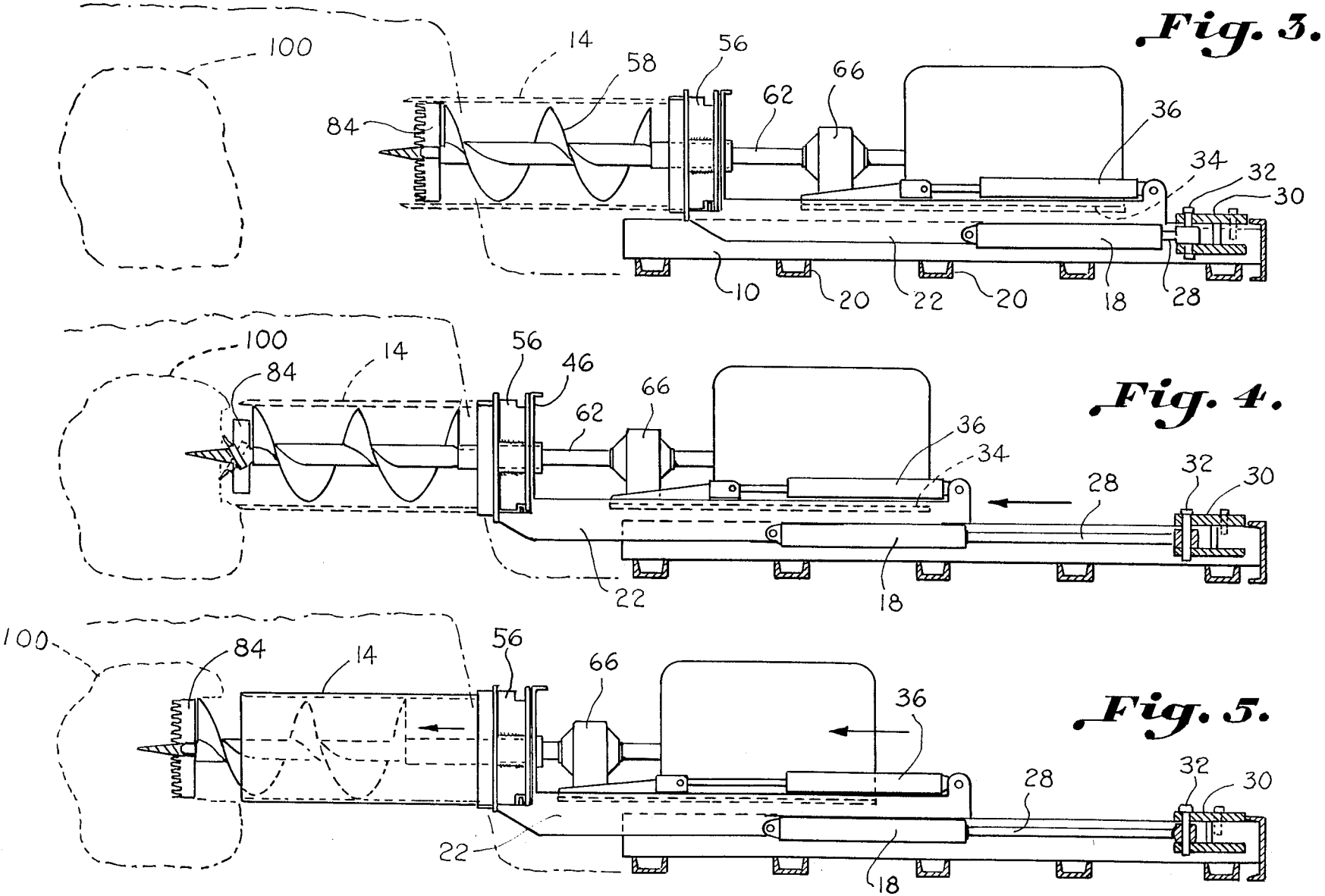
FIGS. 3, 4 and 5 are side elevational views illustrating the various positions of the slides and cutting member during a boring operation and when such engages a rock.

Referring now in more detail to FIGS. 4, 5 and 6, a description of the operation will take place. In normal cutting operation, the auger 58 with the cutting head 84 provided on the end thereof is carried within the guiding sleeve 14. During the tunneling operation, the guiding sleeve 14 is forced into the embankment of the main hydraulic cylinder 18 causing the piston 28 to be extended. This is accomplished entirely by the main cylinder 18. Such continues until a rock is encountered. When the guiding sleeve 14 strikes a rock, it is prevented from being forced further. Up until this time, the auger 58 was merely being used to convey the dirt entering the open end of the guiding sleeve 14 to the paddle wheels 56 for being thrown to the side of a machine. However, at this time, a cutting head 84 is attached to the end of the auger 58 or, in some instances, it may already have been attached. The hydraulic cylinders 36 and 38 then cause the upper second sled 34 to be moved relative to the lower sled 22. As a result, the auger with the cutting tool 84 provided thereon extends out beyond the guiding sleeve 14 and cuts through the rock generally identified by the reference character 100. After the cutting head 84 has penetrated the rock 90, then the entire auger is retracted back within the guiding sleeve 14 by manipulating the lever 74 which controls the fluid to the double-acting hydraulic cylinders 36 and 38.

While in the preferred embodiment described above the auger is shifted forward on a sled in order to project the cutting tool out beyond the end of the tube, it is to be understood that other means could be used for moving the cutting tool and the remote end of the auger out beyond the end of the guiding sleeve such as mechanisms for selectively varying the overall length of the auger.

It will be understood, of course, that while the form of the invention herein shown and described constitutes a preferred embodiment of the invention, it is not intended to illustrate all possible forms of the invention. It will also be understood that the words used are words of description rather than of limitation and that various changes may be made without departing from the spirit and scope of the invention herein disclosed.

I claim:

1. An earth boring machine for boring straight and level elongated holes through rock-laden earth and inserting lengths of pipe in said bored hole comprising:

a stationary horizontally extending frame;

a first slide carried on said stationary elongated frame;

a second slide carried on said first slide;

an elongated auger guiding sleeve carried adjacent one end of said first slide, said guiding sleeve having a cutting edge on a remote end thereof, said guiding sleeve being a length of tubular pipe to be inserted in a bored hole;

a power-driven auger assembly carried on said second slide, said power-driven auger including an elongated auger carried within said guiding sleeve;

a cutting tool carried on the end of said auger adjacent a remote end of said length of pipe;

means for advancing said first slide driving said cutting edge of said guiding sleeve into said earth while said power-driven auger removes said earth as said guiding sleeve is advanced into a bored hole in said earth, means for retracting said first slide after said guiding sleeve has been advanced and inserted in said bored hole for attaching another length of pipe to said previously inserted length of pipe and to said one end of said first slide, and means for advancing said second slide on said first slide advancing said cutting tool out beyond said remote end of said guiding sleeve for cutting through obstructions in the earth.

2. The earth boring machine as set forth in claim 1 further comprising:

a circular clamping member carried adjacent said one end of said first slide;

an inner end of said elongated auger guiding sleeve being held by said circular clamping member;

a shank portion of said elongated auger extending through said circular clamping member forming part of said power-driven auger assembly, said shank portion being moved axially through said circular clamping member.

3. The earth boring machine as set forth in claim 1 further comprising:

a source of pressurized hydraulic fluid, said means for advancing said first slide including a first hydraulic cylinder; and means for selectively supplying said pressurized hydraulic fluid to said first hydraulic cylinder for advancing said first slide.

4. The earth boring machine as set forth in claim 3 further comprising:

said means for advancing said second slide on said first slide for advancing said cutting tool out beyond said remote end of said guiding sleeve including a second hydraulic cylinder, and means for selectively supplying said pressurized hydraulic fluid to said second hydraulic cylinder for advancing said cutting tool out beyond said guiding sleeve.

5. The earth boring machine as set forth in claim 1 further comprising:

a bearing means supporting said auger permitting said auger to be rotated in said guiding sleeve; and a shank portion of said auger extending through said bearing means.

* * * * *